US006689739B1

(12) United States Patent
Hall

(10) Patent No.: US 6,689,739 B1
(45) Date of Patent: Feb. 10, 2004

(54) DETERGENT COMPOSITIONS

(75) Inventor: Robin Gibson Hall, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 205 days.

(21) Appl. No.: 09/936,402

(22) PCT Filed: Sep. 29, 2000

(86) PCT No.: PCT/US00/08417

§ 371 (c)(1),
(2), (4) Date: Sep. 11, 2001

(87) PCT Pub. No.: WO00/60040

PCT Pub. Date: Oct. 12, 2000

(30) Foreign Application Priority Data

Apr. 1, 1999 (GB) ..... 9907568

(51) Int. Cl.[7] ..... C11D 3/08

(52) U.S. Cl. ..... 510/507; 510/276; 510/334; 510/509; 510/485; 510/511

(58) Field of Search ..... 510/276, 334, 510/507, 509, 511, 485

(56) References Cited

U.S. PATENT DOCUMENTS 5,668,073 A * 9/1997 Convents et al. ..... 502/320
5,759,982 A * 6/1998 Wise et al. ..... 510/352

FOREIGN PATENT DOCUMENTS

EP 299575 A1 1/1989
EP 387426 * 9/1990
EP 710713 * 5/1996

* cited by examiner

*Primary Examiner*—Charles Boyer
(74) *Attorney, Agent, or Firm*—Julia A. Glazer; Brahm J. Corstanie; Kim William Zerby

(57) ABSTRACT

The present invention relates to detergent compositions which comprise low levels of inorganic sulphate filler salts, but instead high levels of carbonate salts and a system to counter balance the carbonate. This system comprises a floculating agent and a clay. Preferably only very low levels of an inorganic sulphate salt are present. Preferably, also other salts or silicates are present, including phosphates and/or zeolites.

13 Claims, No Drawings

DETERGENT COMPOSITIONS

TECHNICAL FIELD

The present invention relates to detergent compositions which comprise low levels of inorganic sulphate salts, but instead high levels of carbonate salts and a system to counter balance the effects of the carbonate salt.

BACKGROUND OF THE INVENTION

Many detergent compositions comprise filler salts such as sodium sulphate. Certain formulations even comprise very high levels of such sulphate salts, in particular low density products sometimes comprise more than 30% by weight of sulphates.

However, it is desirable to reduce the level of inorganic sulphates in the products, in particular from an environmental point of view. To replace the inorganic sulphate salts, other inorganic materials can be used. Some of these materials may for example be detergent builders including zeolites, phosphates or silicates. However, these ingredients may increase the formulation cost significantly. Also, high levels of phosphates as fillers are not acceptable in all countries for environmental reasons. Other, cheaper inorganic materials include for example inorganic carbonate salts, which can be readily formulated in detergents. They have as additional benefit that they provide a high alkalinity which is advantageous for the detergency.

However, the inventors have found that formulations comprising high levels of inorganic carbonate salts can cause hardness or stiffness to the fabrics washed with these products. Therefore, the inventors found that the products need to contain a system to counteract the fabric hardness or stiffness.

Numerous compounds are known in the art which can provide a softer feel of fabrics. However, they are not always compatible with high amounts of carbonate salts.

The inventors now found that in particular certain mineral clays can help to overcome the problems caused by the high levels of carbonate salts. However, they found that a clay alone would not be sufficient to provide the required softness when these high amount of carbonate salts are present, but that a flocculating agent is required as well.

Clays and flocculants are known in the art to provide softness to fabrics. They are for example described in EP 313146-A. However, it was previously not known that the clays and flocculating agents can counteract the disadvantages of high levels of carbonate.

SUMMARY OF THE INVENTION

The invention relates to a detergent composition comprising a) a clay;

b) a flocculating agent;

c) at least 18%, preferably at least 20% by weight of an alkali and/ or earth alkali salt of carbonate.

The invention also relates to the use of a clay and a flocculating agent compositions comprising 18% by weight or more of alkali and/ or earth alkali carbonate salt.

The compositions preferably comprise low levels of sulphate.

The compositions are useful for both automatic washing and hand washing, including also pre-treatment, soaking and conditioning.

Carbonate Salts

The carbonate salts for use herein include any carbonate salts, but are in particular alkali and/ or earth alkali carbonate salts, in particular carboante, bicarbonate and sesquicarbonate salts. Preferred salts include carbonate, sesqiocarbonate and hydrogen carbonate of potassium, lithium, sodium, and the like amongst which sodium and potassium carbonate are preferred. Suitable bicarbonates to be used herein include any alkali metal salt of bicarbonate like lithium, sodium, potassium and the like, amongst which sodium and potassium bicarbonate are preferred. However, the choice of carbonate or bicarbonate or mixtures thereof in the dry effervescent granules may be made depending on the pH desired in the aqueous medium wherein the granules are dissolved. For example where a relative high pH is desired in the aqueous medium (e.g., above pH 9.5) it may be preferred to use carbonate alone or to use a combination of carbonate and bicarbonate wherein the level of carbonate is higher than the level of bicarbonate. The inorganic alkali and/or earth alkali carbonate salt of the compositions of the invention comprises preferably a potassium or more preferably a sodium salt of carbonate and/or bicarbonate. Preferably, the carbonate salt comprises sodium carbonate, optionally also a sodium bicarbonate.

The inorganic carbonate salts herein are preferably present at a level of at least 20% by weight of the composition. Preferably they are present at a level of at least 23% or even 25% or even 30% by weight, preferably up to about 60% by weight or more preferably up to 55% or even 50% by weight.

They may be added completely or partially as separate powdered or granular component, as co-granules with other detergent ingredients, for example other salts or surfactants. In solid detergent compositions of the invention, they may also completely or partially be present in detergent granules such as agglomerates or spray dried granules.

In one embodiment of the invention, an effervescence source is present, preferably comprising an organic acid, such as carboxylic acids or aminoacids, and a carbonate. Then it may be preferred that part or all of the carbonate salt herein is premixed with the organic acid, and thus present in an separate granular component.

The carbonate may have any particle size. In one embodiment, in particular when the carbonate salt is present in a granule and not as separately added compound, the carbonate salt has preferably a volume median particle size from 5 to 375 microns, whereby preferably at least 60%, preferably at least 70% or even at least 80% or even at least 90% by volume, has a particle size of from 1 to 425 microns. More preferably, the carbonate salt particles has a volume median particle size of 10 to 250, whereby preferably at least 60%, or even at least 70% or even at least 80% or even at least 90% by volume, has a particle size of from 1 to 375 microns; or even preferably a volume median particle size from 10 to 200 microns, whereby preferably at least 60%, preferably at least 70% or even at least 80% or even at least 90% by volume, has a particle size of from 1 to 250 microns.

In particular when the carbonate salt is added as separate component, so to say 'dry-added' or admixed to the other detergent ingredients, the carbonate may have any particle size, including the above specified particle sizes, but preferably at least an volume average particle size of 200 microns or even 250 microns or even 300 microns.

It may be preferred that the carbonate salt of the required particle size is obtained by grinding a larger particle size material, optionally followed by selecting the material with the required particle size by any suitable method.

Whilst percarbonate salts may be present in the compositions of the invention as a bleaching agent, they are not included in the carbonate salts as defined herein Clay The compositions of the invention contain a clay, preferably present at a level of from 0.05% to 40%, more preferably from 0.5% to 30%, most preferably from 2% to 20% by weight of the composition. For clarity, it is noted that the term, as used herein, excludes sodium aluminosilicate zeolite builder compounds, which however, may be included in the compositions of the invention as optional components.

The weight ratio of clay to the flocculating polymer is preferably from 1000:1 to 1:1, more preferably from 500:1 to 1:1, most preferably from 300:1 to 1:1, or even more preferably from 80:1 to 10:1, or in certain applications even from 60:1 to 20:1.

One preferred clay may be a bentonite clay. Highly preferred are smectite clays, as for example are disclosed in the U.S. Pat. Nos. 3,862,058 3,948,790, 3,954,632 and 4,062,647 and European Patents Nos. EP-A-299,575 and EP-A-313,146 all in the name of the Procter and Gamble Company.

The term smectite clays herein includes both the clays in which aluminium oxide is present in a silicate lattice and the clays in which magnesium oxide is present in a silicate lattice. Typical smectite clay compounds include the compounds having the general formula $Al_2(Si_2O_5)_2(OH)_2.nH_2O$ and the compounds having the general formula $Mg_3(Si_2O_5)_2(OH)_2.nH_2O$. Smectite clays tend to adopt an expandable three layer structure.

Specific examples of suitable smectite clays include those selected from the classes of the montmorillonites, hectorites, volchonskoites, nontronites, saponites and sauconites, particularly those having an alkali or alkaline earth metal ion within the crystal lattice structure. Sodium or calcium montmorillonite are particularly preferred.

Suitable smectite clays, particularly montrnorillonites, are sold by various suppliers including English China Clays, Laviosa, Georgia Kaolin and Colin Stewart Minerals.

Clays for use herein preferably have a largest particle dimension of from 0.01 $\mu$m to 800 $\mu$m, more preferably from 1 mm to 400 mm, most preferably from 5 mm to 200 mm.

Particles of the clay mineral compound may be included as components of agglomerate particles containing other detergent compounds. Where present as such components, the term "largest particle dimension" of the clay mineral compound refers to the largest dimension of the clay mineral component as such, and not to the agglomerated particle as a whole.

Substitution of small cations, such as protons, sodium ions, potassium ions, magnesium ions and calcium ions, and of certain organic molecules including those having positively charged functional groups can typically take place within the crystal lattice structure of the smectite clays. A clay may be chosen for its ability to preferentially absorb one cation type, such ability being assessed by measurements of relative ion exchange capacity. The smectite clays suitable herein typically have a cation exchange capacity of at least 50 meq/100 g. U.S. Pat. No. 3,954,632 describes a method for measurement of cation exchange capacity.

The crystal lattice structure of the clay mineral compounds may have, in a preferred execution, a cationic fabric softening agent substituted therein. Such substituted clays have been termed 'hydrophobically activated' clays, as for example sold under the tradename Claytone EM by English China Clays International. The cationic fabric softening agents are typically present at a weight ratio, cationic fabric softening agent to clay, of from 1:200 to 1:10, preferably from 1:100 to 1:20. Suitable cationic fabric softening agents include the water insoluble tertiary amines or dilong chain amide materials as disclosed in GB-A-1 514 276 and EP-B-0 011 340.

Organophilic clays may also be used herein. These are hydrophobically modified clays which have organic ions replacing inorganic metal ions by ion exchange processes known in the art. These kinds of clay are readily mixable with organic solvent and have the capability to absorb organic solvent at the interlayers. Suitable examples or organophilic clays useful in the invention are Bentone SD-1, SD-2 and SD-3 from Rheox of Highstown, N.J.

In a highly preferred embodiment of the invention, the clay is present in an intimate mixture or in a particle with a humectant and a hydrophobic compound, preferably a wax or oil, such as paraffin oil. Preferred humectants are organic compounds, including propylene glycol, ethylene glycol, dimers or trimers of glycol, most preferably glycerol. The particle is preferably an agglomerate. Alternatively, the particle may be such that the wax or oil and optionally the humectant form an encapsulate on the clay or alternatively, the clay be a encapsulate for the wax or oil and the humectant. It may be preferred that the particle comprises an organic salt or silica or silicate.

However, in another embodiment of the invention, the clay is preferably mixed with one or more surfactants and optionally builders and optionally water, in which case the mixture is preferably subsequently dried. Preferably, such a mixture is further processed in a spray-drying method to obtain a spray dried particle comprising the clay.

It may be preferred that the flocculating agent is also comprised in the particle or granule comprising the clay.

It may be highly preferred that the clay, and optionally also the flocculating polymer, is present in a mixture with a wax and a structering agent. Examples of suitable structuring agents which can be used in particles comprising the clay herein include relatively small hydrophobic solid particles such as hydrophobic silica and relatively high molecular weight hydrocarbons such as hydrocarbon rubber.

Hydrophobic silicas are silica particles with a hydrophobic group chemically attached to the surface of the particles. Silica particles can be hydrophobically modified with organic group such as silicone by treating the silica particles with a reactive organosilicon compound. Examples are Cab-O-Sil TS720 and TS530 available from Cabot Corporation and Aerosil 200 supplied by Degussa Corp.

The submicron hydrophobic filmed silicas such as those supplied by Cabot Co. under the trademarks Cab-O-Sil TS720 and TS530 are especially preferred.

High molecular weight hydrocarbons include homo- or copolymers of ethylene, propylene and butadiene having a molecular weight of about 50,000 to about 5,000,000. Suitable examples include Ortheleium® polyethylenepropylne elastomers supplied by DuPont Corporation.

Examples of suitable waxes which can be present in the particles containing the clay, or be mixed with the clay, are commercially available include (1) paraffin wax such as Merck 7150, Merck 7151 supplied by E. Merck or Darmsteadt Germany; Boler 1397, Boler 1538 supplied by Boler of Wayne, Pa., and Ross 115/120 or 1365 supplied by Frank D Ross Co of Jersey City N.J.; (2) Beeswax and (3) Japan Wax also supplied by Frank P Ross Co. Inc. of New Jersey;

and (4) Petrolatum waxes such as Petrolatum Pereco Snow or Petrolatum Penreco Ultima supplied by Penreco of Pennsylvania.

A blend of paraffin wax and petrolatum wax is preferred as the coating material especially for liquid actives, such as liquid nonionic surfactants. Paraffin waxes are highly crystallised materials.

It may also be preferred that the intimate mixture comprises a chelating agent as described herein after.

Flocculating Agent

The compositions of the invention may contain a clay flocculating agent, preferably present at a level of from 0.005% to 10%, more preferably from 0.05% to 5%, most preferably from 0.1% to 2% by weight of the composition.

The clay flocculating agent functions such as to bring together the particles of clay compound in the wash solution and hence to aid their deposition onto the surface of the fabrics in the wash. This functional requirement is hence different from that of clay dispersant compounds which are commonly added to laundry detergent compositions to aid the removal of clay soils from fabrics and enable their dispersion within the wash solution.

Preferred as clay flocculating agents herein are organic polymeric materials having an average weight of from 100,000 to 10,000,000, preferably from 150,000 to 5,000,000, more preferably from 200,000 to 2,000,000.

Suitable organic polymeric materials comprise homopolymers or copolymers containing monomeric units selected from alkylene oxide, particularly ethylene oxide, acrylamide, acrylic acid, vinyl alcohol, vinyl pyrrolidone, and ethylene imine. Homopolymers of, on particular, ethylene oxide, but also acrylamide and acrylic acid are preferred.

European Patents No.s EP-A-299,575 and EP-A-313,146 in the name of the Procter and Gamble Company describe preferred organic polymeric clay flocculating agents for use herein.

Inorganic clay flocculating agents are also suitable herein, typical examples of which include lime and alum.

The flocculating agent is preferably present in a detergent base granule such as a detergent agglomerate, extrudate or spray-dried particle, comprising generally one or more surfactants and builders.

Detergent Compositions

The cleaning compositions of the invention are preferably solid, in the form of granules, extrudates, flakes, bars or tablets.

The compositions can be used in automatic washing or hand washing. Also, the compositions can be such that they are suitable for pre-treatment or soaking, or for conditioning of the fabric after the main wash.

The compositions in accord with the invention may also contain additional detergent components. The precise nature of these additional components, and levels of incorporation thereof will depend on the physical form of the composition or component, and the precise nature of the washing operation for which it is to be used.

The compositions of the invention preferably contain one or more additional detergent components selected from surfactants, bleaches, bleach catalysts, alkalinity systems, additional builders, including phosphate-containing builders, organic polymeric compounds, enzymes, suds suppressers, soaps, lime soap, dispersants, soil suspension and anti-redeposition agents soil releasing agents, perfumes, brighteners, photo-bleaching agents and additional corrosion inhibitors.

Preferably, the composition comprises low levels of inorganic sulphate salts, in particular sodium sulphate, preferably less than 15% or even less than 10% by weight, or more preferably less than 8% or even less than 5% by weight. It may even be preferred that substantially no inorganic sulphate salts are purposely added to the detergent composition and that the compositions comprise thus less than 1% or even less than 0.5% or even substantially no inorganic sulphate salt.

Highly preferred is that the compositions comprise an anionic surfactant, preferably at least 5% of an anionic surfactant or even at least 10% or even at least 15% of an anionic surfactant. Preferably the anionic surfactant comprises at least an linear or branched $C_9$–$C_{24}$, preferably $C_{11}$–$C_{14}$ alkyl benzene sulphonate salt. It has been found that the anionic surfactants have a better performance than other surfactants when high levels of carbonate are present. However, nonionic surfactants may be included to provide additional softness to the fabrics and, in particular in hand wash formulations where they can also provide softness to the skin. Highly preferred may be that at least 3% by weight of the composition, or even at least 5% or even 6% by weight, of an alkoxylated nonionic surfactant is present, or preferably mixtures thereof. Preferred mixtures include mixtures of alkoxylated nonionic alcohol surfactants having different degrees of alkoxylation, preferably at least one surfactant having an alkoxylation degree of from 3 to 5 and at least one having an alkoxylation degree of from 5.5. to 11.

It may be preferred that the compositions comprises one or more of the group comprising morphous silicate, crystalline layered silicate, aluminosilicate or phosphate salt, preferably at least 6% or even at least 10% by weight. It may be preferred that at least 6% or even at least 8% or even at least 10% by weight of a phosphate salt is present.

The solid or granular formulations herein may comprise water. In a preferred embodiment, in particular when a spray-dried granule is present in the detergents, at least 5% by weight or even at least 7% by weight of water is present.

Highly preferred additional ingredients are soil release polymers, in particular polyesters or polysaccherides or derivatives thereof, cellulose based polymers, including carboxy methyl cellulose, cellulose ethers or ester or amine or amide modified celluloses, encapsulated perfumes, effervescence sources, preferably based on carbonate and acid compounds, in particular citric acid, malic acid or maleic acid, phosphonate-builders, dye transfer inhibitors, and process aids such as hydrotropes. These ingredients are described in more detail herein.

Highly preferred may be to include a carboxy methyl cellulose compound at a level of at least 0.5% or even 0.75% or even 1% by weight of the composition, or alternatively, or in addition a polysaccheride at a level of at least 0.5% or even 0.75% or even 1% by weight of the composition.

It may be preferred that the compositions comprise a cationic softener. Highly preferred water-insoluble quaternary ammonium compounds are those having two $C_{2}$–$C_{24}$ alkyl or alkenyl chains, optionally substituted by functional groups such as —OH, —O—, —CONH, —COO— etc.

Well known species of substantially water-insoluble quaternary ammonium compounds have the formula $$R_1R_2R_3R_4N\ X$$

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethylammonium chloride; ditallow dimethyl ammonium methyl sulfate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimehtyl ammonium methosulfate are preferred.

Also suitable herein are the imidaxolinium fabric softening components of U.S. Pat. No. 4,127,489, incorporated by reference. As used herein the term "fabric softening agent" excludes, cationic detergent active materials which have a solubility above 10 g/l in water at 20° C. at a pH of about 6.

Especially preferred is ditallowyl methylamine. This is commercially available as Armeen M2HT from AKZO NV, as Genamin SH301 from FARBWERKE HOECHST, and as Noram M2SH from the CECA COMPANY.

Surfactant

The compositions in accord with the invention preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The compositions in accord with the present invention preferably comprise an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/ or sulfonate and alkyl ethoxysulfate surfactants. Such mixtures have been disclosed in PCT patent application Ser. No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—CON ($R^1$)$CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10\text{-}18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO$— wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12\text{-}18}$ dimethylammonio hexanoate and the $C_{10\text{-}18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

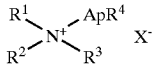

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

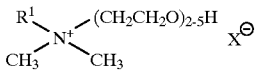

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-alkoxylated Amine Surfactant

The cationic bis-alkoxylated amine surfactant preferably has the general formula II:

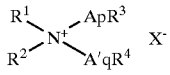

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

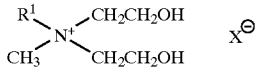

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the

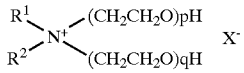

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

An preferred additional components of the compositions is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid.

Potassium peroxymonopersulfate, sodium per is another optional inorganic perhydrate salt of use in the detergent compositions herein.

Organic Peroxyacid Bleaching System

A preferred feature of the composition is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

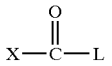

where L is a leaving group and X is essentially any functionality, such that on perhydroloysis the structure of the peroxyacid produced is

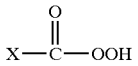

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

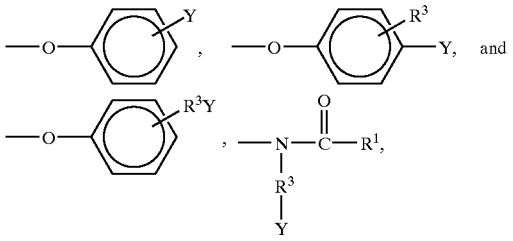

-continued

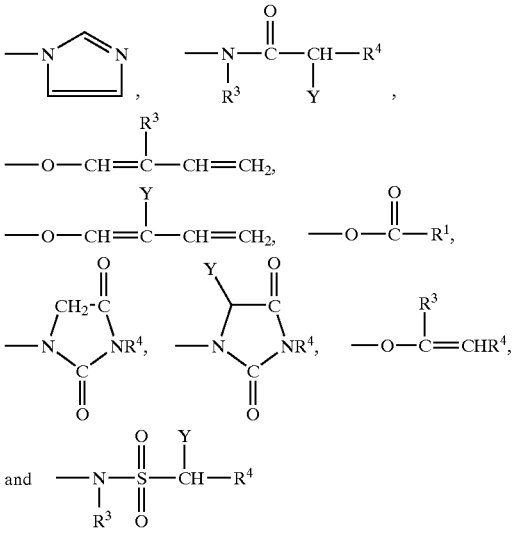

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Plkyl Peroxyacid Precursors

Amide substituted alkyl peroxyacid precursor compounds are suitable herein, including those of the following general formulae:

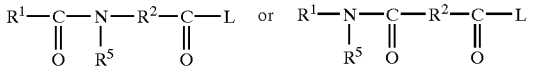

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

The organic peroxyacid bleaching system may contain, in addition to, or as an alternative to, an organic peroxyacid bleach precursor compound, a preformed hydrophobic organic peroxyacid , typically at a level of from 0.05% to 20% by weight, more preferably from 1% to 10% by weight of the composition.

A preferred class of hydrophobic organic peroxyacid compounds are the amide substituted compounds of the following general formulae:

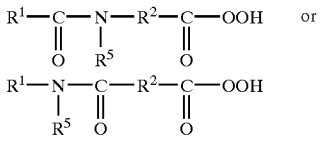

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386. Suitable examples of this class of agents include (6-octylanino)-6-oxo-caproic acid, (6-nonylamino)-6-oxo-caproic acid, (6-decylamino)-6-oxo-caproic acid, magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, U.S. Pat. No. 4,634,551, EP 0,133,354, U.S. Pat. No. 4,412,934 and EP 0,170,386. A preferred hydrophobic preformed peroxyacid bleach compound for the purpose of the invention is monononylamido peroxycarboxylic acid.

Other suitable organic peroxyacids include diperoxyalkanedioc acids having more than 7 carbon atoms, such as diperoxydodecanedioc acid, diperoxytetradecanedioc acid and diperoxyhexadecanedioc acid.

Other suitable organic peroxyacids include diamino peroxyacids, which are disclosed in WO 95/03275, with the following general formula:

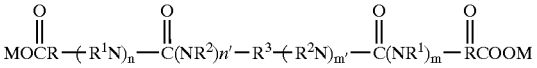

wherein:

R is selected from the group consisting of $C_1$–$C_{12}$ alkylene, $C_5$–$C_{12}$ cycloalkylene, $C_6$–$C_{12}$ arylene and radical combinations thereof;

$R^1$ and $R^2$ are independently selected from the group consisting of H, $C_1$–$C_{16}$ alkyl and $C_6$–$C_{12}$ aryl radicals and a radical that can form a $C_3$–$C_{12}$ ring together with $R^3$ and both nitrogens; $R^3$ is selected from the group consisting of $C_1$–$C_{12}$ alkylene, $C_5$–$C_{12}$ cycloalkylene and $C_6$–$C_{12}$ arylene radicals; n and n' each are an integer chosen such that the sun thereof is 1; m and m' each are an integer chosen such that the sum thereof is 1; and M is selected from the group consisting of H, alkali metal, alkaline earth metal, ammonium, alkanolammonium cations and radicals and combinations thereof.

Other suitable organic peroxyacids are include the amido peroxyacids which are disclosed in WO 95/16673, with the following general structure:

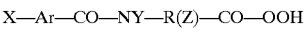

in which X represents hydrogen or a compatible substituent, Ar is an aryl group, R represents $(CH_2)_n$ in which n=2 or 3, and Y and Z each represent independently a substituent selected from hydrogen or an alkyl or aryl or alkaryl group or an aryl group substituted by a compatible substituent provided that at least one of Y and Z is not hydrogen if n=3. The substituent X on the benzene nucleus is preferably a hydrogen or a meta or para substituent, selected from the group comprising halogen, typically chlorine atom, or some other non-released non-interfering species such as an alkyl group, conveniently up to C6 for example a methyl, ethyl or propyl group. Alternatively, X can represent a second amido-percarboxylic acid substituent of formula:

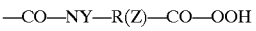

in which R, Y, Z and n are as defined above.

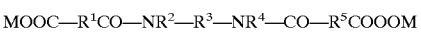

wherein $R^1$ is selected from the group consisting of $C_1$–$C_{12}$ alkylene, $C_5$–$C_{12}$ cycloalkylene, $C_6$–$C_{12}$ arylene and radical combinations thereof; R Highly preferred herein is phthaloylamido peroxyacid (PAP).

Bleach Catalyst

The composition can contain a transition metal containing bleach catalyst.

One suitable type of bleach catalyst is a catalyst system comprising a transition metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful herein may also be selected as appropriate for the present invention. For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

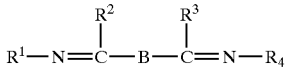

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S. $CR^5R^6$, $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe, -bispyridylmethane and -bispyridylamine complexes. Highly preferred catalysts include Co(2,2'-bispyridylamine)$Cl_2$, Di(isothiocyanato) bispyridylarnine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

The bleach catalyst is typically used in a catalytically effective amount in the compositions and processes herein. By "catalytically effective amount" is meant an amount which is sufficient, under whatever comparative test conditions are employed, to enhance bleaching and removal of the stain or stains of interest from the target substrate. The test conditions will vary, depending on the type of washing appliance used and the habits of the user. Some users elect to use very hot water; others use warm or even cold water in laundering operations. Of course, the catalytic performance of the bleach catalyst will be affected by such considerations, and the levels of bleach catalyst used in fully-formulated detergent and bleach compositions can be appropriately adjusted. As a practical matter, and not by way of limitation, the compositions and processes herein can be adjusted to provide on the order of at least one part per ten million of the active bleach catalyst species in the aqueous washing liquor, and will preferably provide from about 1 ppm to about 200 ppm of the catalyst species in the wash liquor. To illustrate this point further, on the order of 3 micromolar manganese catalyst is effective at 40° C., pH 10 under European conditions using perborate and a bleach precursor. An increase in concentration of 3–5 fold may be required under U.S. conditions to achieve the same results.

Water-Soluble Builder Compound

The compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent compositions of the invention preferably comprise phosphate-containing builder material. Preferably present at a level of from 0.5% to 60%, more preferably from 5% to 50%, more preferably from 8% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates.

Suitable aluminosilicate zeolites have the unit cell formula $Na_z[(AlO_2)_z(SiO_2)_y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276 H_2O$.

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Heavy Metal Ion Sequestrant

The compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, and 1,1 hydroxyethane dimethylene phosphonic acid. Highly preferred is 1,1 hydroxyethane diphosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and imino-disuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful in the compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradenames Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Ternamyl, Durwamyl and BAN by Novo Industries A/S. Highly preferred amylase enzymes maybe those described in PCT/US9703635, and in W095/26397 and W096/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola spr. Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuzinosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Additional Organic Polymeric Compound

Organic polymeric compounds are preferred additional components of the compositions herein and are preferably present as components of any particulate components where they may act such as to bind the particulate component together. By organic polymeric compound it is meant herein essentially any polymeric organic compound commonly used as dispersants, and anti-redeposition and soil suspension agents in detergent composition.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Polyethylene oxides are preferred additional ingredients, in particular present in a particle with the clay herein, as a humectant, preferably also combined with a wax or oil.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No.60/051517.

Another organic compound, which is a preferred clay dispersant/anti-redeposition agent, for use herein, can be the ethoxylated cationic monoamines and diamines of the formula:

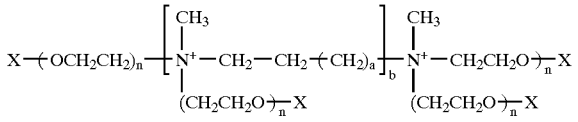

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelarnines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Also highly preferred is the presence of soap.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners.

Hydrophilic optical brighteners useful herein include those having the structural formula:

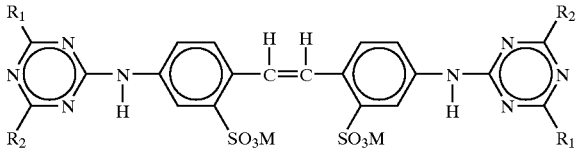

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradenames Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Deflocculating Polymers

Preferred deflocculating agents which may be present herein contain hydrophilica monomers, which may be polymerized to form the hydrophilic polymer segment include one or a mixture of water soluble monomers or a combination of water soluble and relatively water insoluble monomers such that the resulting polymers are water soluble at ambient temperatures to the extent of greater than about 10 grams per liter. Examples of suitable such monomers include ethylenically unsaturated amides such as acrylamide, methacrylamide and fumaramide and their N-substituted derivatives such as 2-acrylamido-2-methylpropane sulfonic acid, N-(dimethylaminomethyl) acrylamide as well as N-(trimethylanuoniummethyl) acrylamide chloride and N-(trimethylammoniumpropyl) methacrylamide chloride; ethylenically unsaturated carboxylic acids or dicarboxylic acids such as acrylic acid, maleic acid, methacrylic acid, itaconic acid, fumaric acid, crotonic acid, aconitic acid and citraconic acid; and other ethylenically unsaturated quaternary ammonium compounds such as vinyl-benzyl trimnethyl ammonium chloride; sulfoalkyl esters of unsaturated carboxylic acids such as 2-sulfoethyl methacrylate; aminoalkyl esters of unsaturated carboxylic acisds such as 2-aminoethyl methacrylate, dimethyl aminoethyl (meth)acrylate, diethyl aminoethyl (meth)acrylate, dimethyl aminomethyl (meth)acrylate, diethyl aminomethyl (meth)acrylate, and their quaternary ammonium salts; vinyl or alkyl amines such as vinyl pyridine and vinyl morpholine or allylamine; dially amines and diallyl ammonium compounds such as diallyl dimethyl ammonium chloride; vinyl heterocyclic amides such as vinyl pyrrolidone; vinyl aryl sulfonates such as vinylbenzyl sulfonate; vinyl alcohol obtained by the hydrolysis of vinyl acetate; acrolein; allyl alcohol; vinyl acetic acid; sodium vinyl sulphonate; sodium allyl sulphonate, as well as the salts of the foregoing monomers. These monomers may be used singly or as mixtures thereof Optionally, the hydrophilic polymer segment may contain small amounts of relatively hydrophobic units, e.g., those derived from polymers having a solubility of less than 1 g/l in water, provided that the overall solubility of the hydrophilic polymer still satisfies the solubility requirements as specified above. Examples of relatively water insoluble polymers are polyvinyl acetate, polymethyl methacrylate, polyethyl acrylate, polyethylene, polypropylene, polystyrene, polybutylene oxide, polypropylene oxide and polyhydroxypropyl acrylate.

Theses polymers may preferably be alkyl sulfide terminated polymers, or a polymers with as a terminating group a sulfoxide or a sulfone group or a hydrophobic merapto end-cap group derived from a mercaptan having the structure RSH, where R is an alkyl or aralkyl radical having 4 to 28 carbon atoms. R should be of sufficient chain length such that it exhibits olephilic properties, i.e., it is miscible with the oily lamellar droplet or micelle phase of the detergent composition. Preferably, the mercaptans are alkyl or aralkyl mercaptans containing about 6 to 18 carbon atoms such as hexyl mercaptan, decyl mercaptan, dodecylbenzyl mercaptan, dodecyl mercaptan and octadecyl mercaptan.

Preferred deflocculating polymers of these types have a weight average molecular weight, as measured by gel permeation chromatography using polyacrylate standards, in the range of from about 200 to 50,000, more preferably from about 200 to 25,000 and most preferably for polymers based on polyacrylic and polymethacrylic acid, from about 3,000 to 10,000. The most preferred polymers are hydrophilic homopolymers such as polyacrylic or polymethacrylic acid and copolymers of acrylic or methacrylic acid with less than 50 wt % or maleic acid (anhydride), wherein the bulk of the polymer chains are end-capped with a single hydrophobic segment derived from dodecyl mercaptan.

These polymers and their method of preparation are further disclosed in copending U.S. application Ser. No. 08/212611, filed on Mar. 14, 1994, the complete disclosure of which is incorporated herein by reference.

Polymeric Soil Release Agent

Polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK. Also highly preferred are polysaccheride polymers.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the compositions of the invention include perfumes, colours and other filler salts as replacement for sulphate filler salt.

Highly preferred compositions contain from about 2% to about 10% by weight of an organic acid, preferably citric acid, malic acid, maleic acid, acetic acid, tartaric acid, glutaric acid or an aminoacid.

Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides, photo-bleaches, speckles, dyes, such as those described in U.S. Pat. No. 4,285,841 to Barrat et al., issued Aug. 25, 1981 (herein incorporated by reference), can be present.

Form of the Compositions

The composition of the invention can be made via a variety of methods, including dry-mixing, agglomerating, compaction, or spray-drying of the various compounds comprised in the detergent component, or mixtures of these techniques.

The compositions herein can take a variety of physical forms including liquid, but preferably solid forms such as tablet, flake, pastille and bar, and preferably granular forms.

The compositions in accord with the present invention can also be used in or in combination with bleach additive compositions, for example comprising chlorine bleach.

Detergent compositions herein, in particular laundry detergents, preferably have a bulk density of from 280 g/liter to 200 g/liter, or preferably from 300 g/liter or even 350 g/liter or 420 g/liter to 2000 g/liter or more preferably to 1500 g/liter or 100 g/liter or even to 700 g/liter.

Chlorine-Based Bleach

The detergent compositions can include as an additional component a chlorine-based bleach. However, since preferred detergent compositions of the invention are solid, most liquid chlorine-based bleaching will not be suitable for these detergent compositions and only granular or powder chlorine-based bleaches will be suitable.

Alternatively, the detergent compositions can be formulated such that they are chlorine-based bleach-compatible, thus ensuring that a chlorine based bleach can be added to the detergent composition by the user at the beginning or during the washing process.

The chlorine-based bleachis such that a hypochlorite species is formed in aqueous solution. The hypochlorite ion is chemically represented by the formula $OCl^-$.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods.

The compositions herein can be useful in both conventional washing machines and low-water fill washing machines.

In a preferred use aspect the composition hand washing. In another preferred aspect the detergent composition is a pre-treatment or soaking composition, to be used to pre-treat or soak soiled and stained fabrics.

Abbreviations Used in Examples

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| SADS | Sodium $C_{14}$–$C_{22}$ alkyl disulfate of formula 2-(R).$C_4H_7$.-1,4-$(SO_4—)_2$ where R = $C_{10}$–$C_{18}$ |
| SADE2S | Sodium $C_{14}$–$C_{22}$ alkyl disulfate of formula 2-(R).$C_4H_7$.-1,4-$(SO_4—)_2$ where R = $C_{10}$–$C_{18}$, condensed with z moles of ethylene oxide |
| MES | x-sulpho methylester of $C_{18}$ fatty acid |
| APA | $C_8$–$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{16}$–$C_{18}$ topped whole cut fatty acids |

-continued

| | |
|---|---|
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 | Crystalline layered silicate of formula δ- $Na_2Si_2O_5$ |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enyme, having 5.3% by weight of active enzyine, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/US9703635 |
| Lipase | Lipolytic enzyme, having 2.0% by weight of active enzyme, sold by NOVO Industries A/S under the tradename Lipolase |
| Lipase II | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| PAP | Phthaloylamido peroxyacid |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photo-activated | Sulfonated zinc phthlocyanine encapsulated in bleach (1) dextrin soluble polymer |
| Photo-activated | Sulfonated alumino phthlocyanine encapsulated in bleach (2) dextrin soluble polymer |

-continued

| | |
|---|---|
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidasole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis($(C_2H_5O)(C_2H_4O)_n$)($CH_3$)—$N^+$—$C_6H_{12}$—$N^+$—($CH_3$) bis($(C_2H_5O)$—$(C_2H_4O))_n$, wherein n = from 20 to 30 |
| PEI | Polyethyleneimine with an average molecular weight of 1800 and an average ethoxylation degree of 7 ethyleneoxy residues per nitrogen |
| Clay I | Bentonite clay |
| Clay II | Smectite clay |
| Flocculating agent I | polyethylene oxide of average molecular weight of between 200,000 and 400,000 |
| Flocculating agent II | polyethylene oxide of average molecular weight of between 400,000 and 1,000,000 |
| Flocculating agent III | polymer of acrylamide and/or acrylic acid of average molecular weight of 200,000 and 400,000 |
| SRP I | Anionically end-capped polyester soil release polymer |
| SRP II | Polysaccheride soil release polymer |
| SRP 1 | Nonionically end capped poly esters |
| SRP 2 | Diethoxylated poly (1,2 propylene terephtalate) short block polymer |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |
| Speckle | Coloured carbonate salt or organic carboxylic acid/salt |

In the following examples all levels are quoted as % by weight of the composition:

EXAMPLE 1

The following detergent formulations are in accord with the invention.

| | A | B | C | D |
|---|---|---|---|---|
| Blown powder | | | | |
| Clay I or II | 7.0 | 10.0 | 6.0 | 2.0 |
| Flocculating agent I or II | 0.3 | 1.0 | 1.0 | 0.5 |
| LAS | 16.0 | 5.0 | 11.0 | 6.0 |
| TAS | — | 5.0 | — | 2.0 |
| Zeolite A | — | 20.0 | — | 10.0 |
| STPP | 24.0 | — | 14.0 | — |
| Sulfate | — | 2.0 | — | — |
| MA/AA | — | 2.0 | 1.0 | 1.0 |
| Silicate | 4.0 | 7.0 | 3.0 | — |
| CMC | 1.0 | — | 0.5 | 0.6 |
| Brightener | 0.2 | 0.2 | 0.2 | 0.2 |
| Sodium carbonate | 10.0 | 10.0 | 20.0 | — |
| DTPMP | 0.4 | 0.4 | 0.2 | — |
| Spray on | | | | |
| Brightener | 0.02 | — | — | 0.02 |
| C45E7 or E9 | — | — | 2.0 | 1.0 |

-continued

| | A | B | C | D |
|---|---|---|---|---|
| C45E3 or E4 | — | — | 2.0 | 4.0 |
| Perfume | 0.5 | — | 0.5 | 0.2 |
| Silicone antifoam | 0.3 | — | — | — |
| Dry additives | | | | |
| QEA | — | — | — | 1.0 |
| HEDP/EDDS | 0.3 | — | — | — |
| Sulfate | 2.0 | — | — | |
| Carbonate | 20.0 | 13.0 | 15.0 | 24.0 |
| Citric acid | 2.5 | — | — | 2.0 |
| QAS | — | — | 0.5 | 0.5 |
| SKS-6 | 3.5 | — | — | 5.0 |
| Percarbonate | — | — | — | 9.0 |
| PB4 | — | — | 5.0 | |
| PAP/NOBS | — | — | — | 1.3 |
| TAED | — | — | 2.0 | 1.5 |
| Protease | 1.0 | 1.0 | 1.0 | 1.0 |
| Lipase | — | 0.4 | — | 0.2 |
| Amylase | 0.2 | 0.2 | 0.2 | 0.4 |
| Brightener | 0.05 | — | — | 0.05 |
| Perfume | 1.0 | 0.2 | 0.5 | 0.3 |
| Speckle | 1.2 | 0.5 | 2.0 | — |
| Misc/minor to 100% | | | | |

EXAMPLE 2

The following granular detergent formulations are in accord with the invention.

| | E | F | G | H | I | J |
|---|---|---|---|---|---|---|
| Blown powder | | | | | | |
| LAS | 23.0 | 8.0 | 7.0 | 9.0 | 7.0 | 7.0 |
| QAS | — | — | — | — | 1.0 | — |
| C45AS | 6.0 | 6.0 | 5.0 | 8.0 | — | — |
| C45AE3S | — | 1.0 | 1.0 | 1.0 | — | — |
| MES | — | — | — | — | 2.0 | 4.0 |
| STPP/Zeolite A | 10.0 | 18.0 | 18.0 | 20.0 | 10.0 | 10.0 |
| MA/AA | — | 0.5 | — | — | — | 2.0 |
| MA/AA (1) | 7.0 | — | — | — | — | — |
| AA | — | 3.0 | 3.0 | 2.0 | 3.0 | 3.0 |
| Sulfate | 2.0 | 6.0 | 1.0 | — | — | — |
| Silicate | 10.0 | — | 2.0 | 7.0 | 1.0 | 1.0 |
| Carbonate | 25.0 | 20.0 | 10.0 | 20.0 | 14.0 | — |
| PEG 4000 | 0.4 | 1.5 | 1.5 | 1.0 | 1.0 | 1.0 |
| DTPA | — | 0.9 | 0.5 | — | — | 0.5 |
| Brightener | 0.3 | 0.2 | 0.3 | — | 0.1 | 0.3 |
| Flocculating agent I or III | 0.5 | 0.1 | 0.2 | 0.8 | 1.5 | 0.2 |
| Spray on | | | | | | |
| C45B7 | — | 2.0 | — | — | 2.0 | 2.0 |
| C25E9 | 3.0 | — | — | — | — | — |
| C23E9 | — | — | 1.5 | 2.0 | — | 2.0 |
| Perfume | 0.3 | 0.3 | 0.3 | 2.0 | 0.3 | 0.3 |
| Agglomerates | | | | | | |
| C45AS | — | 5.0 | 5.0 | 2.0 | — | 5.0 |
| LAS | — | 2.0 | 2.0 | — | — | 2.0 |
| STPP? Zeolite A | — | 7.5 | 7.5 | 8.0 | — | 7.5 |
| Carbonate | — | 4.0 | 4.0 | 5.0 | — | 4.0 |
| PEG 4000 | — | 0.5 | 0.5 | — | — | 0.5 |
| Misc (water etc) | — | 2.0 | 2.0 | 2.0 | — | 2.0 |
| Agglomerate | | | | | | |
| Clay I or II | 10.0 | 4.0 | 3.0 | 15.0 | 7.0 | 6.0 |
| Wax | 0.7 | — | — | 1.0 | 0.5 | 1.0 |
| Dry additives | | | | | | |
| QAS (I) | — | — | — | — | 1.0 | — |
| Citric acid | — | — | — | — | 2.0 | — |

-continued

| | E | F | G | H | I | J |
|---|---|---|---|---|---|---|
| PB4 | — | 3.0 | — | — | — | — |
| PB1 | — | — | 4 | 1.0 | — | — |
| Percarbonate | 12.0 | — | — | 1.0 | — | 2.0 |
| Carbonate | — | 5.3 | 20.0 | 5.0 | 14.0 | 24.0 |
| NOBS | 0.5 | — | 0.4 | 0.3 | — | 0.6 |
| DOBS/PAP | — | 0.9 | — | — | 0.3 | — |
| TAED | 0.6 | 0.4 | 0.6 | 0.3 | 0.9 | 0.5 |
| Methyl cellulose | 0.2 | — | — | — | — | 0.5 |
| DTPA | 0.7 | 0.5 | 1.0 | 0.5 | 0.5 | 1.2 |
| Speckle | 0.3 | 0.2 | 2.0 | — | 0.7 | 0.5 |
| SKS-6 | 8.0 | — | — | — | — | — |
| STS | — | — | 2.0 | — | 1.0 | — |
| Cumene sulfonic acid | — | 1.0 | — | — | — | 2.0 |
| Lipase | 0.2 | — | 0.2 | — | 0.2 | 0.4 |
| Cellulase | 0.2 | 0.2 | 0.2 | 0.3 | 0.2 | 0.2 |
| Amylase II | 0.2 | — | 0.1 | — | 0.2 | — |
| Protease | 0.5 | 0.5 | 0.5 | 0.3 | 0.5 | 0.5 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP I, II, or III | 0.2 | 0.5 | 0.3 | — | 0.2 | — |
| Silicone antifoam | 0.2 | 0.4 | 0.2 | — | 0.1 | — |
| Mg sulfate | — | — | 0.2 | — | 0.2 | — |
| Misc/minors to 100% | | | | | | |

EXAMPLE 3

The following granular detergent formulations are in accord with the invention.

| | K | L | M | N |
|---|---|---|---|---|
| Base granule | | | | |
| STPP | — | 22.0 | — | 15.0 |
| Zeolite A | 30.0 | — | 24.0 | 5.0 |
| Sulfate | — | — | 2.0 | 5.0 |
| MA/AA | 3.0 | — | — | — |
| AA | — | 1.6 | 2.0 | — |

-continued

| | K | L | M | N |
|---|---|---|---|---|
| Flocculating agent I or II | 0.2 | 0.1 | 0.5 | — |
| LAS | 14.0 | 10.0 | 19.0 | 26.0 |
| C45A5 | 8.0 | 7.0 | 2.0 | — |
| C45AE3S | 2.0 | 1.0 | — | — |
| MES | — | 4.0 | — | — |
| Clay I or II | 12.5 | 8.0 | 10.0 | 5.0 |
| Silicate | 4.0 | 1.0 | — | 10.0 |
| Soap | — | 2.0 | 2.0 | 3.0 |
| Brightener 1 | 0.2 | 0.2 | 0.2 | 0.2 |
| Carbonate | 16.0 | 19.0 | 10.0 | 20.0 |
| PEG 4000 | — | 1.0 | 1.5 | — |
| C25E3 or E4 | 2.0 | — | 3.0 | — |
| C45E5 or E7 | 2.0 | — | — | — |
| DTPA | — | 0.4 | — | — |
| Spray on | | | | |
| C25E3 or E4 | — | — | — | 2.0 |
| C45E5 or E7 | — | — | — | 2.0 |
| Brightener/photobbleach | — | — | 0.5 | 0.5 |
| Perfume | 0.2 | 0.3 | 0.3 | — |
| Dry additives | | | | |
| Carbonate | 15.0 | 10.0 | 13.0 | 5.0 |
| PVPVI/PVNO | 0.5 | — | 0.3 | — |
| Protease | 1.0 | 1.0 | 1.0 | 0.5 |
| Lipase | 0.4 | — | — | 0.4 |
| Amylase | 0.1 | — | — | 0.1 |
| Cellulase | 0.1 | 0.2 | 0.2 | 0.1 |
| DTPA | 0.5 | 0.3 | 0.5 | 1.0 |
| Clay I or II (wax) | — | — | — | 5.0 |
| PB1 | 5 | 3.0 | 10 | 4.0 |
| PAP/DOBA | 1.0 | — | 0.4 | — |
| TAED | 0.5 | 0.3 | 0.5 | 0.6 |
| Sulfate | 4.0 | 5.0 | — | 5.0 |
| SRP I, II or III | 0.2 | 0.4 | 1.0 | 0.5 |
| Sud supressor | — | 0.5 | — | — |
| Speckle | 1.8 | 0.8 | 0.7 | 1.2 |
| Flocculating agent | — | — | 0.1 | 0.2 |
| Perfume (starch) | — | 0.2 | 0.3 | 0.5 |
| Misc/minor to 100% | | | | |

EXAMPLE 4

The following is a composition in the form of a tablet or granular formulation in accord with the invention.

| | O | P | R | S | T | U | V | W | X | Y | Z |
|---|---|---|---|---|---|---|---|---|---|---|---|
| Sodium $C_{11}$–$C_{13}$ alkyl-benzene sulfonate | 12.0 | 16.0 | 23.0 | 19.0 | 18.0 | 20.0 | 16.0 | 8.5 | 5 | 20.0 | 6.0 |
| Sodium $C_{14}$–$C_{15}$ alcohol sulfate | | 4.5 | — | | — | — | 4.0 | | — | — | — |
| $C_{14}$–$C_{15}$ alcohol ethoxylate (0.5) sulfate | | | — | — | — | — | — | — | — | — | — |
| $C_{14}$–$C_{15}$ alcohol ethoxylate (3) sulfate | — | — | 2.0 | — | 1.0 | 1.0 | 1.0 | — | — | — | — |
| Sodium $C_{14}$–$C_{15}$ alcohol ethoxylate (or mixtures of different ethoxylation degree) | 2.0 | 2.0 | — | 1.3 | — | — | 5.0 | 5.5 | 4.0 | — | — |
| $C_9$–$C_{14}$ alkyl dimethyl hydroxy ethyl quaternary ammonium salt | | | — | — | 1.0 | 0.5 | 2.0 | — | — | — | — |
| Tallow fatty acid | | | — | — | — | — | 1.0 | — | — | — | — |
| Tallow alcohol ethoxylate (50) | — | — | — | — | — | — | — | — | — | — | — |
| Sodium tripolyphosphate/ Zeolite | 23.0 | 25.0 | 14.0 | 22.0 | 20.0 | 10.0 | 20.0 | 30.0 | 20.0 | 25.0 | 25.0 |

-continued

| | O | P | R | S | T | U | V | W | X | Y | Z |
|---|---|---|---|---|---|---|---|---|---|---|---|
| Sodium carbonate | 25.0 | 22.0 | 35.0 | 20.0 | 28.0 | 41.0 | 30.0 | 30.0 | 25.0 | 45.0 | 24.0 |
| Sodium Polyacrylate (45%) | 0.5 | 0.5 | 0.5 | 0.5 | — | — | — | — | — | — | — |
| Sodium polyacrylate/ maleate polymer | — | — | 1.0 | 1.0 | 1.0 | 2.0 | 0.5 | 0.5 | 1.0 | — | — |
| Sodium silicate (1:6 ratio $NaO/SiO_2$) (46%) | 3.0 | 6.0 | 9.0 | 8.0 | 9.0 | 6.0 | 8.0 | 5.0 | 6.0 | 8.0 | 5.0 |
| Sodium sulfate | — | — | — | — | — | 2.0 | 3.0 | — | — | — | 8.0 |
| Sodium perborate/ percarbonate | 5.0 | 5.0 | 10.0 | — | 3.0 | 1.0 | — | 20.0 | 14.0 | — | — |
| Poly(ethyleneglycol), MW ~4000 (50%) | 1.5 | 1.5 | 1.0 | 1.0 | — | — | 0.5 | — | — | — | 0.5 |
| Sodium carboxy methyl cellulose | 1.0 | 1.0 | 1.0 | — | 0.5 | 0.5 | 0.5 | 0.5 | 0.5 | — | 0.5 |
| Citric acid | — | — | — | — | — | — | — | — | — | — | — |
| NOBS/DOBS | — | 1.0 | — | — | 1.0 | 0.7 | — | — | — | — | — |
| TAED/PAP | 1.5 | 1.0 | 2.5 | — | 3.0 | 0.7 | — | 4.5 | 5.0 | — | — |
| Chelant | 0.5 | 0.5 | 0.5 | — | 1.0 | — | — | 0.5 | 0.5 | — | |
| SRP | 1.5 | 1.5 | 1.0 | 1.0 | — | 1.0 | — | 1.0 | 1.0 | — | — |
| Clay I or II | 5.0 | 6.0 | 12.0 | 7.0 | 10.0 | 4.0 | 3.0 | 7.0 | 10.0 | 6.0 | 8.0 |
| Flocculating agent I or III | 0.2 | 0.2 | 3.0 | 2.0 | 0.1 | 1.0 | 0.5 | 2.0 | 0.5 | 1.0 | 0.5 |
| Humectant | 0.5 | 1.0 | 0.5 | 1.0 | 0.5 | 0.5 | — | 1.0 | 0.5 | — | — |
| Wax | 0.5 | 0.5 | 1.0 | — | — | 0.5 | 0.5 | 0.3 | 0.5 | 0.5 | — |
| Moisture | 7.5 | 7.5 | 6.0 | 7.0 | 5.0 | 3.0 | 5.0 | 5.0 | 5.0 | 8.0 | 10.0 |
| Magnesium sulphate | — | — | — | — | — | 0.5 | 1.5 | — | — | — | — |
| Soap/suds suppressor | — | — | 0.5 | 0.5 | 0.8 | 0.6 | 1.0 | 1.0 | 0.8 | 0.5/0.0 | 1.0/0.0 |
| Enzymes, including amylase, cellulase, protease and lipase | — | — | — | — | 2.0 | 1.5 | 2.0 | 0.5 | 1.0 | 1.0 | 1.0 |
| Speckle | 2.5 | 1.1 | 0.5 | 1.4 | — | — | 2.2 | 1.0 | 1.6 | 1.0 | |
| minors, e.g. perfume, PVP, PVPVI/PVNO, brightener, photo-bleach, | 2.0 | 1.0 | 1.0 | 1.0 | 2.5 | 1.5 | 1.0 | 1.0 | 0.5 | 0.5 | 0.5 |

EXAMPLE 5

The following are compositions in the form of a tablet, bar, extrudate or granule in accord with the invention.

| | AA | BB | CC | DD |
|---|---|---|---|---|
| Sodium $C_{11}$–$C_{13}$ alkylbenzenesulfonate | 23.0 | 13.0 | 20.0 | 18.0 |
| Sodium $C_{14}$–$C_{15}$ alcohol sulfate | — | 4.0 | — | — |
| Clay I or II | 5.0 | 10.0 | 14.0 | 6.0 |
| Flocculating agent I or II | 0.2 | 0.3 | 0.1 | 0.9 |
| Wax | 0.5 | 0.5 | 1.0 | — |
| Humectant (glycerol/silica) | 0.5 | 2.0 | 1.5 | — |
| $C_{14}$–$C_{15}$ alcohol ethoxylate sulfate | — | | — | 2.0 |
| Sodium $C_{14}$–$C_{15}$ alcohol ethoxylate ( | 2.5 | 3.5 | — | — |
| $C_9$–$C_{14}$ alkyl dimethyl hydroxy ethyl quaternary ammonium salt | | — | — | 0.5 |
| Tallow fatty acid | 0.5 | — | — | — |
| Tallow alcohol ethoxylate (50) | — | — | | 1.3 |
| Sodium tripolyphosphate | — | 41.0 | — | 20.0 |
| Zeolite A, hydrate (0.1–10 micron size) | 26.3 | — | 21.3 | — |
| Sodium carbonate | 24.0 | 22.0 | 35.0 | 27.0 |
| Sodium Polyacrylate (45%) | 2.4 | — | 2.7 | — |
| Sodium polyacrylate/maleate polymer | — | — | 1.0 | 2.5 |
| Sodium silicate (1.6 or 2 or 2.2 ratio $NaO/SiO_2$)(46%) | 4.0 | 7.0 | 2.0 | 6.0 |
| Sodium sulfate | — | 6.0 | 2.0 | — |
| Sodium perborate/ percarbonate | 8.0 | 4.0 | — | 12.0 |

-continued

| | AA | BB | CC | DD |
|---|---|---|---|---|
| Poly(ethyleneglycol), MW ~4000 (50%) | 1.7 | 0.4 | 1.0 | — |
| Sodium carboxy methyl cellulose | 1.0 | — | — | 0.3 |
| Citric acid | — | — | 3.0 | — |
| NOBS/DOBS | 1.2 | — | — | 1.0 |
| TAED | 0.6 | 1.5 | — | 3.0 |
| Perfume | 0.5 | 1.0 | 0.3 | 0.4 |
| Soil release polymer | — | 1.5 | 1.0 | 1.0 |
| Moisture | 7.5 | 3.1 | 6.1 | 7.3 |
| Magnesium sulphate | — | — | — | 1.0 |
| Chelant | — | — | — | 0.5 |
| speckle | 1.0 | 0.5 | 0.2 | 2.7 |
| Enzymes, including amylase, cellulase, protease and lipase | — | 1.0 | — | 1.5 |
| minors, e.g. brightener, photo-bleach | 1.0 | 1.0 | 1.0 | 1.0 |

EXAMPLE 6

The following detergent compositions are according to the present invention

| | EE | EE | FF | GG | HH |
|---|---|---|---|---|---|
| Blown Powder | | | | | |
| STPP/Zeolite A | 9.0 | 15.0 | 15.0 | 9.0 | 9.0 |
| Flocculating agent II or III | 0.5 | 0.2 | 0.9 | 1.5 | — |
| LAS | 7.5 | 23.0 | 3.0 | 7.5 | 7.5 |
| QAS | 2.5 | 1.5 | — | — | — |
| DTPMP | 0.4 | 0.2 | 0.4 | 0.4 | 0.4 |
| HEDP or EDDS | — | 0.4 | 0.2 | — | — |

-continued

| | EE | EE | FF | GG | HH |
|---|---|---|---|---|---|
| CMC | 0.1 | 0.4 | 0.4 | 0.1 | 0.1 |
| Sodium carbonate | 5.0 | 20.0 | 20.0 | 10.0 | — |
| Brightener | 0.05 | — | — | 0.05 | 0.05 |
| Clay I or II | — | 10.0 | — | — | — |
| STS | 0.5 | — | — | 0.5 | 0.5 |
| MA/AA | 1.5 | 2.0 | 2.0 | 1.5 | 1.5 |
| Agglomerates | | | | | |
| Suds suppresser (silicon) | 1.0 | 1.0 | — | 2.0 | 0.5 |
| Agglomerate | | | | | |
| Clay | 9.0 | — | — | 4.0 | 10.0 |
| Wax | 0.5 | — | — | 0.5 | 1.5 |
| Glycerol | 0.5 | — | — | 0.5 | 0.5 |
| Agglomerate | | | | | |
| LAS | — | 5.0 | 5.0 | — | — |
| TAS | — | 2.0 | 1.0 | — | — |
| Silicate | — | 3.0 | 4.0 | — | — |
| Zeolite A | — | 8.0 | 8.0 | — | — |
| Carbonate | — | 8.0 | 4.0 | — | — |
| Spray On | | | | | |
| Perfume | 0.3 | — | — | 0.3 | 0.3 |
| C45E7 or E9 | 2.0 | — | — | 2.0 | 2.0 |
| C25E3 or E4 | 2.0 | — | — | 2.0 | 2.0 |
| Dry additives | | | | | |
| Citrate or citric acid | 2.5 | — | 2.0 | 2.5 | 2.5 |
| Clay I or II | — | 5.0 | 5.0 | — | — |
| Flocculating agent I or II | — | — | — | — | 0.2 |
| Bicarbonate | — | 3.0 | — | — | — |
| Carbonate | 15.0 | — | — | 25.0 | 31.0 |
| TAED | 1.0 | 2.0 | 5.0 | 1.0 | — |
| Sodium perborate or percarbonate | 6.0 | 7.0 | 10.0 | 6.0 | — |
| SRP I, II or III | 0.2 | 0.1 | 0.2 | 0.5 | 0.3 |
| CMC or nonionic cellulose ether | 1.0 | 1.5 | 0.5 | — | — |
| Protease | 0.3 | 1.0 | 1.0 | 0.3 | 0.3 |
| Lipase | — | 0.4 | 0.4 | — | — |
| Amylase | 0.2 | 0.6 | 0.6 | 0.2 | 0.2 |
| Cellulase | 0.2 | 0.6 | 0.6 | 0.2 | 0.2 |
| Silicone antifoam | — | 5.0 | 5.0 | — | — |
| Perfume (starch) | 0.2 | 0.3 | 1.0 | 0.2 | 0.2 |
| Speckle | 0.5 | 0.5 | 0.1 | — | 1.0 |
| SKS-6 (silicate 2R) | 3.5 | — | — | — | 3.5 |
| Photobleach | 0.1 | — | — | 0.1 | 0.1 |
| Soap | 0.5 | 2.5 | — | 0.5 | 0.5 |
| Sodium sulfate | — | 3.0 | — | — | — |
| Misc/minors to 100% | 100.0 | 100.0 | 100.0 | 100.0 | 100.0 |
| Density (g/litre) | 850 | 850 | 850 | 850 | 850 |

What is claimed is:

1. A detergent composition comprising (a) a clay;

(b) a flocculating agent; and (c) at least 18% by weight of an alkali or earth alkali salt of carbonate; wherein said clay and said flocculating agent are present in a spray-dried or an agglomerated granule comprising a wax.

2. A composition according to claim 1 wherein the flocculating agent is a polyethylene oxide of an average molecular weight from 150,000 to 3,000,000.

3. A composition according to claim 1 wherein the clay comprises a smectite clay.

4. A composition according to claim 1 wherein less than 10%, by weight of inorganic alkali or earth alkali sulphate salt is present.

5. A composition according to claim 1 wherein at least 5% by weight of an anionic surfactant is present.

6. A composition according to claim 1 comprising at least 6% by weight of an ingredient selected from the group consisting of amorphous silicate, crystalline layered silicate, aluminosilicate, phosphate salt, and mixtures thereof.

7. A solid composition according to claim 1 comprising at least 5% by weight of water.

8. A composition according to claim 1 comprising a fabric care component selected from the group consisting of soil release polymers, cellulosic polymers, dye transfer inhibitors, cationic softeners, and mixtures thereof.

9. A solid composition according to claim 1 comprising an effervescence source.

10. A detergent composition according to claim 1 comprising a perfume component containing a mixture of perfumes and a carrier or coating material, including a starch.

11. A detergent composition according to claim 1 in the form of a tablet.

12. A detergent composition according to claim 1 comprising a nonionic surfactant.

13. A detergent composition according to claim 1 comprising a mixture of clays.

* * * * *